United States Patent [19]

Rappaport

[11] Patent Number: 4,851,859

[45] Date of Patent: Jul. 25, 1989

[54] TUNABLE DISCONE ANTENNA

[75] Inventor: Theodore S. Rappaport, Blacksburg, Va.

[73] Assignee: Purdue Research Foundation, West Lafayette, Ind.

[21] Appl. No.: 191,055

[22] Filed: May 6, 1988

[51] Int. Cl.[4] ..... H01Q 1/36; H01Q 13/00

[52] U.S. Cl. ..... 343/790; 343/773; 343/830; 343/846; 343/861

[58] Field of Search ..... 343/846, 773–775, 343/794, 830, 829, 790, 791, 860, 861

[56] References Cited

U.S. PATENT DOCUMENTS

| | | | |
|---|---|---|---|
| 2,541,107 | 2/1951 | Selgin | 343/773 |
| 2,771,605 | 11/1956 | Kirkman | 343/773 |
| 3,293,646 | 12/1966 | Brueckman | 343/830 |
| 3,618,107 | 11/1971 | Spanos | 343/773 |
| 3,641,578 | 2/1972 | Spanos et al. | 343/773 |
| 3,671,971 | 6/1972 | Goodbody | 343/846 |
| 3,701,159 | 10/1972 | Simonds | 343/745 |
| 3,742,510 | 6/1973 | Spanos | 343/730 |
| 3,787,865 | 1/1974 | MacDowell et al. | 343/773 |
| 4,143,377 | 3/1979 | Salvat et al. | 343/755 |
| 4,641,317 | 2/1987 | Fullerton | 375/1 |

OTHER PUBLICATIONS

J. J. Nail, "Designing Discone Antennas", *Electronics,* pp. 167–169 (Aug. 1953).

D. A. McNamara, D. E. Baker and L. Botha, "Some Design Considerations for Biconical Antennas," AP-S-6-1, IEEE, pp. 173–176 (1984).

Y. Lakshminarayana, Y. R. Kubba and M. E. Madhusudan, "A Wide Band Discone Antenna", Electro-Technology, pp. 57–59 (Mar.–Apr. 1971).

S. Gibilisco, "Discover the Discone", *ΘFor Radio Amateurs,* pp. 17–20, May, 1985.

F. C. Judd, "Antennas Part 1", *Practical Wireless,* pp. 54–57 (Feb. 1983).

F. C. Judd, "Antennas Part 2", *Practical Wireless,* pp. 52–54 (Mar. 1983).

S. E. Parker, L. G. Robbins, and W. J. E. Edwards, "Composite Discage Antenna Developed for 2-To-3-0-MC/S Band", *Research and Development Report,* Aug. 8, 1967.

K. F. Woodman, "Dielectric-Clad Discone", *Electronics Letters,* pp. 264–265, vol. 13, No. 9, Apr. 28, 1977.

A. G. Kandoian, "Three New Antenna Types and Their Applications", Waves and Electrons, pp. 70–75, Feb. 1946.

T. E. White, "A Discone Antenna for 10 and 6 Meters and Lo-Band Public Service Monitoring", *Amateur Radio,* pp. 74–75, Jun. 1980.

*Primary Examiner*—Rolf Hille
*Assistant Examiner*—Michael C. Wimer
*Attorney, Agent, or Firm*—Barnes & Thornburg

[57] ABSTRACT

A discone antenna has a conducting cone having an apex and a conducting disc with a disc feed conductor extending from its center. The conducting disc is mounted at the apex of the cone in spaced relation therewith such that the disc feed conductor extends down into the cone through the cone's apex. A coaxial connector is mounted within the cone at the apex of the cone and defines a tuning cavity therein. A tuning slug is received in the tuning cavity through the apex of the cone and is vertically adjustable within the tuning cavity to tune the antenna.

14 Claims, 3 Drawing Sheets

TUNABLE DISCONE ANTENNA

This invention was funded in part by a grant from the National Science Foundation. The government may have rights in this invention.

This invention relates to antennas and particularly to discone antennas.

A well known type of antenna is the discone antenna. The discone antenna is a broadband antenna and is relatively simple to construct. Its main virtue is that it provides a low voltage standing wave ratio (VSWR) over a bandwidth of several octaves. The discone antenna, as the name implies, comprises a combination of a disk and a cone and is typically fed by a coaxial feed line. The disk is mounted at the apex of the cone and is connected to the center conductor of the coaxial feed line. The disk is insulated from the cone. The outer conductor of the coaxial feed line is connected to the cone generally at the apex of the cone.

There are known design equations for discone antennas. These equations were developed empirically using the VHF frequency bands which are below the UHF and microwave frequency bands. The critical design parameters of these equations are considered to be to be the disk-to-cone spacing (s), the diameter of the disk (D), and the slant height of the cone (L). Where the minimum cone diameter (m) is small with respect to the high-pass cutoff frequency of the antenna, as is the case for VHF, s is usually assumed to be much less than D and the useful design formulas have been found to be:

$$s = 0.3\ m$$

$$D = 0.7M$$

regardless of the cone flare angle $\theta$, where L is slightly larger than $\lambda/4$ at cutoff. [J. J. Nail, "Designing Discone Antennas," *Electronics*, pp. 167–169 (August, 1953)]

However, at UHF and microwave frequencies, the effect of certain parameters, such as the diameter of the disc feed conductor, which have negligible effect on the performance of the antenna at lower frequencies now becomes appreciable. This is due to the fact that the magnitude of these parameters at frequencies much lower than microwave frequencies is much less than the wavelengths the antenna receives or transmits. For example, at frequencies much lower than microwave frequencies, i.e., VHF, the diameter of the disc feed conductor is much less than the wavelength of the frequencies which the antenna transmits or receives. However, at higher frequencies such as UHF and microwave frequencies, this relationship no longer holds. Thus, the performance of the discone antenna becomes much more sensitive to variations in such parameters which at lower frequencies would have negligible effect on the performance of the discone antenna. Thus, it becomes much more important to be able to tune the discone antenna to achieve optimum performance by adjusting one or more parameters.

It is an object of this invention to provide a discone antenna which provides optimal performance at microwave frequencies.

It is another object of this invention to provide a discone antenna for use with microwave frequencies which can be easily tuned to achieve optimal performance.

It is another object of this invention to provide a discone antenna which can be constructed simply and inexpensively.

It is another object of this invention to provide a simple and inexpensive wide bandwidth antenna.

A discone antenna constructed according to this invention has a conducting cone having an apex and a conducting disc having a disc feed conductor extending from its center. The conducting disc is mounted in spaced relation to the apex of the cone such that the conducting disc's disc feed conductor extends down into the cone through the cone's apex. A tuning cavity defining member is coupled to the cone and defines a tuning cavity about the conducting disc's disc feed conductor at the apex of the cone. A tuning slug is received in the tuning cavity and is vertically adjustable therein to tune the discone antenna. The tuning cavity defining member can be a coaxial connector mounted at an upper end to the cone at the apex of the cone wherein the coaxial connector defines the tuning cavity therein. The discone antenna can be fed by a coaxial feed line which is coupled to the coaxial connector.

Additional features and advantages of the invention will become apparent to those skilled in the art upon consideration of the following detailed description of a preferred embodiment, exemplifying the best mode of carrying out the invention as presently perceived. The detailed description particularly refers to the accompanying figures in which.

Figure 6A:
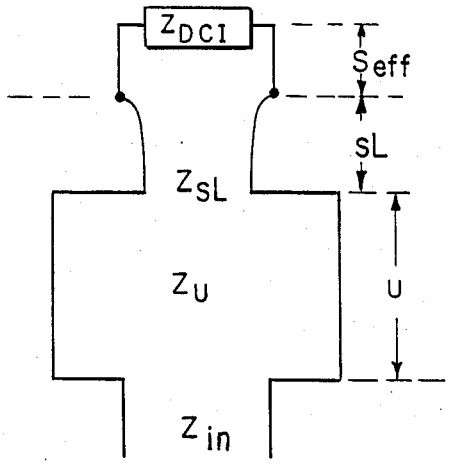
Figure 6B:
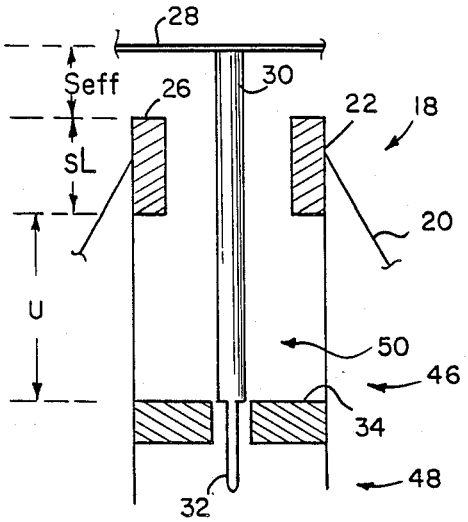
Figure 7:
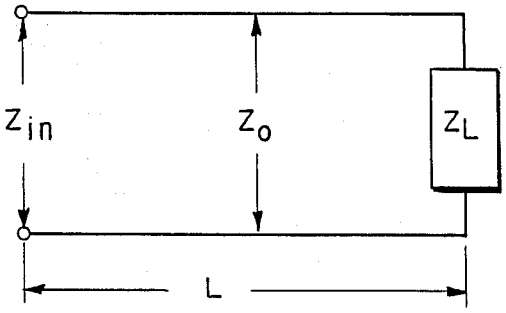

FIGS. 6*a*—6*b* are a schematic of an impedance model for a discone antenna constructed in accordance with the invention and a schematic of a discone antenna constructed in accordance with the invention; and FIG. 7 is a schematic of a transmission line terminated with a complex load.

Figure 1:
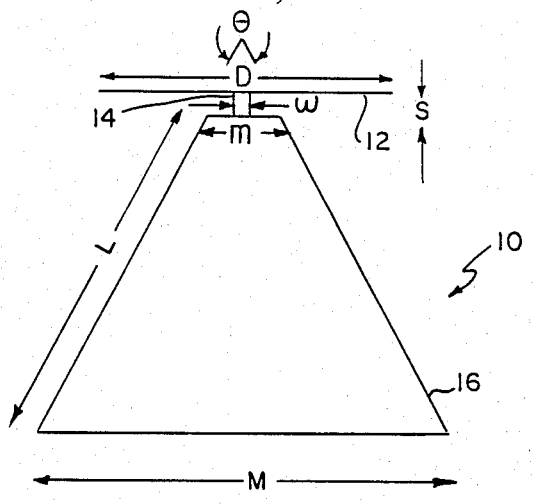
FIG. 1 (PRIOR ART)
FIG. 1 is a schematic of a prior art discone antenna.

Referring to FIG. 1, a prior art discone antenna 10 has a conducting disk 12 with a center conductor or disc feed conductor 14 extending from its center and a conducting cone 16. The conducting disk 12 is mounted generally at the apex of the cone 16 in spaced relation to the apex of the cone 16 and is insulated from the cone 16. The disk feed conductor of the conducting disk extends down into the cone and mates with a feed line (not shown). Discone antenna 10 can be characterized by the dimensions D, L, M, m, $\theta$, s and w, where D is the diameter of the conducting disk 12, L is the slant height of the cone 16, M is the maximum cone diameter, m is the minimum cone diameter (diameter of the cone at its apex), $\theta$ is the flare angle of the cone 16, s is the spacing between disc 12 and cone 16, and w is the diameter of the disc feed conductor 14.

Discone antenna 10 can further be characterized by the following design equations:

$$s = 0.3\ m;$$

$$D = 0.7M;$$

where it is assumed that s<,<D, m≅λ/75 at high-pass cutoff, L is slightly larger than λ/4 at high-pass cutoff, and w is not considered. In these prior art design equations w is not considered because it is much less than $\lambda_c$ (high-pass cutoff) and thus has a negligible effect on the performance of the antenna.

Figure 2:
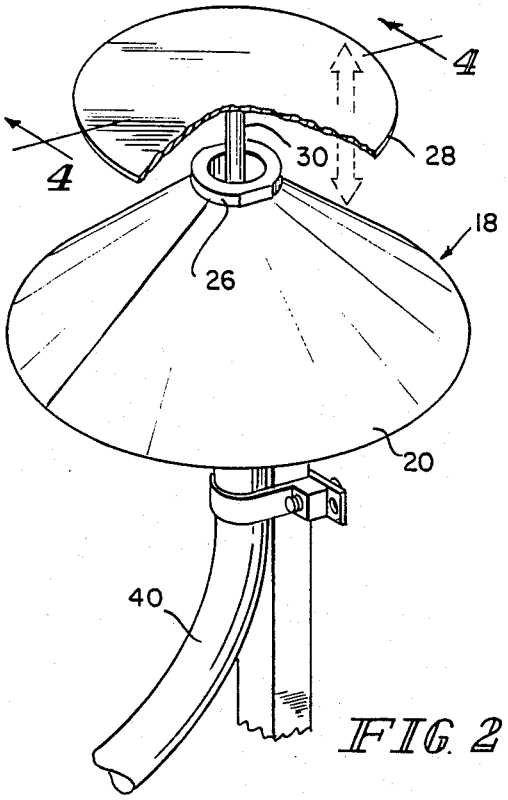
FIG. 2 is a perspective view of a discone antenna constructed in accordance with this invention.
Figure 3:
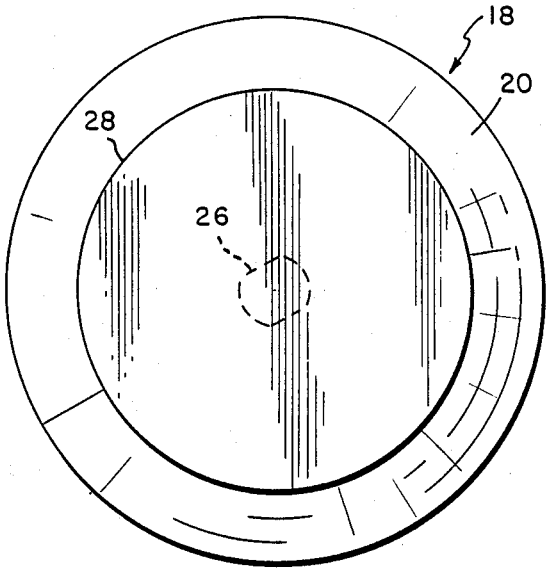
FIG. 3 is a top view of the discone antenna of FIG. 2.
Figure 4:
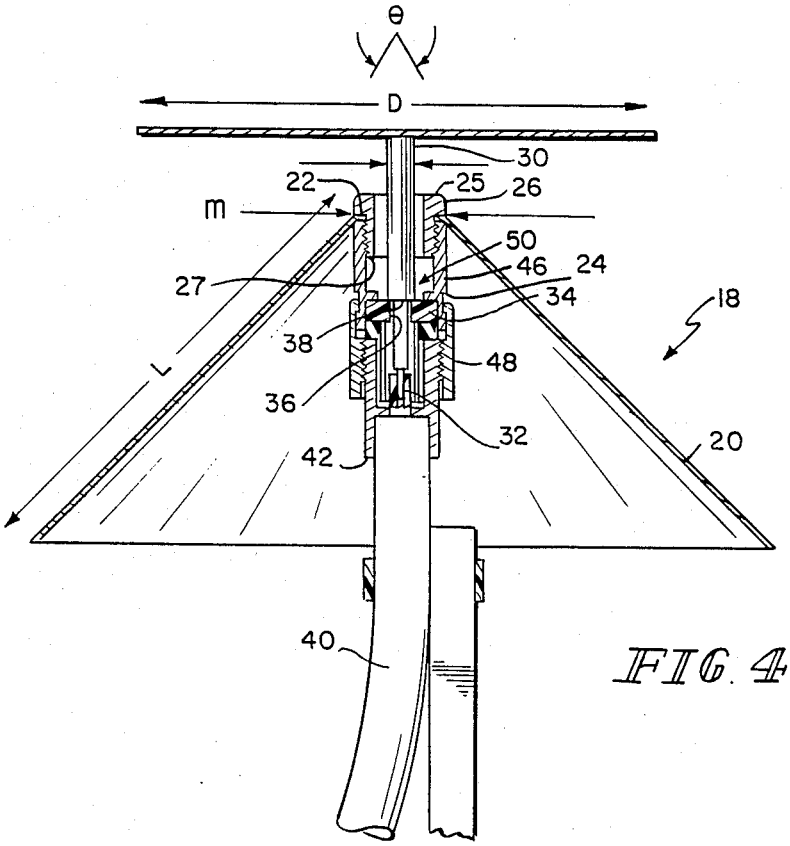
FIG. 4 is a sectional view of the discone antenna of FIG. 2 taken along the line 4—4.

Referring to FIGS. 2–4, a discone antenna 18 constructed in accordance to this invention is shown. Discone antenna 18 has a conducting cone 20 which has an apex 22. A tuning cavity defining member, which is illustratively a coaxial connector 24, is mounted inside cone 20 at the apex 22 of cone 20. Illustratively, coaxial connector 24 is a UG-21d/U male coaxial connector. Coaxial connector 24 is illustratively mounted to the apex 22 of cone 20 by having one end affixed to the apex 22 of cone 20. Coaxial connector 24 provides the RF feed connection for discone antenna 18 and also provides mechanical support for discone antenna 18.

Coaxial connector 24 has an upper portion or throat 46 which defines a tuning cavity 50 and a lower portion or connector head 48. Connector head 48 has a core of dielectric material 34 with a hole 36 extending through the center thereof. The upper end of throat 46 is threaded to threadably receive a tuning slug 26 which is illustratively a cable clamp nut. Tuning slug 26 has an upper portion 25 which extends axially upwards from the apex 22 of cone 20 toward conducting disc 28 and a lower portion 27 which penetrates into tuning cavity 50. Tuning slug 26 is used to tune discones antenna 18 as will be discussed in more detail below.

Discone antenna 18 also includes a conducting disc 28. A disc feed conductor 30 extends from the center of conducting disc 28. A pin 32 extends from a distal end of disc feed conductor 30 of conducting disc 28. The junction of pin 32 and disc feed conductor 30 forms an annular shoulder 38. Conducting disc 28 is mounted at the apex 22 of cone 20 is spaced relation therewith such that the disc feed conductor 30 extends down into cone 20 with the pin 32 extending through the hole 36 in the connector head 48 of coaxial connector 24. Pin 32 illustratively provides the center pin for coaxial connector 24.

Discone antenna 18 is connected to an RF feed source (not shown) or to an RF receiver (not shown) by a coaxial feed line 40. Illustratively, a female coaxial connector 42 is affixed to the end of coaxial feed line 40 and mates with the connector head 48 of coaxial connector 24.

Illustratively, conducting disc 28 is held in spaced relation to the apex 22 of cone 20 by female coaxial connector 42 holding up pin 32 of disc feed conductor 30 such that conducting disc 28 is held in spaced relation to the apex 22 of cone 20. Conducting disc 28 could also be held in spaced relation to the apex 22 of cone 20 by the annular shoulder 38 of disc feed conductor 30 resting against dielectric core 34 of connector head 48 of coaxial connector 24. It should be understood that conducting disc 28 can be mounted to cone 20 in a variety of ways provided that conducting disc 28 is held in spaced relation to the apex 22 of cone 20 and is electrically insulated from cone 20.

Tuning slug 26 is used to tune discone antenna 18. The amount by which tuning slug 26 is threaded into coaxial connector 24 is adjusted to optimize the performance of discone antenna 18 by minimizing the VSWR. As discussed in more detail below, adjusting the distance tuning slug 26 is screwed into coaxial connector 24 effectively adjusts the spacing between conducting disc 28 and the cone 20 by adjusting the distance between the top of tuning slug 26 and conducting disc 28 and also adjusts the impedance of tuning cavity 50.

Figure 5:
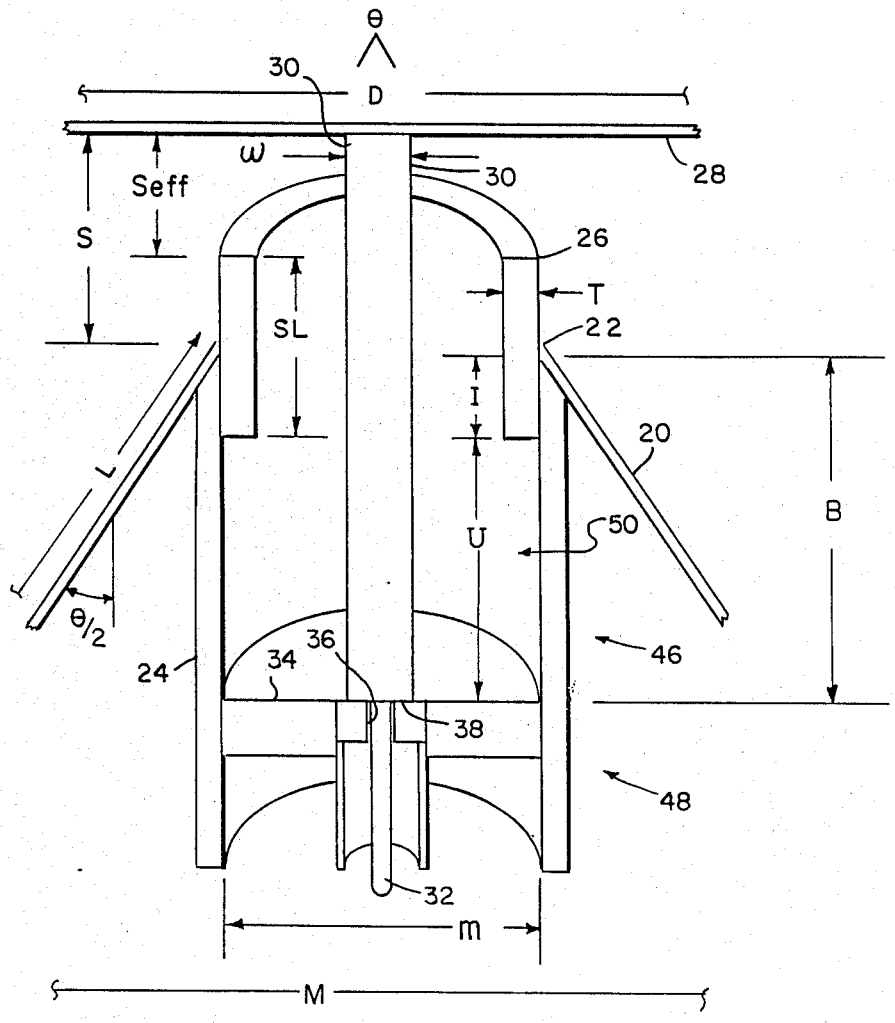
FIG. 5 is a schematic representation of a discone antenna constructed according to this invention showing in more detail the interface between the conducting disc conducting cone, and tuning slug.

FIG. 5 is a schematic representation of discone antenna 18 of FIGS. 2–4 showing particularly the relationship of coaxial connector 24, conducting disc 28 and tuning slug 26 at the apex 22 of cone 20. Discone antenna 18 is characterized here by the same dimensions used to characterize discone antenna 10 of FIG. 1 wherein the diameter of tuning cavity 50 is illustratively equal to m (the minimum cone diameter). Additionally, discone antenna 18 is further characterized by the dimensions $s_{eff}$, sL, I, U, B and T, where $s_{eff}$ is the distance between the top of the tuning slug 26 and the conducting disc 28, sL is the length of the tuning slug 26, T is the wall thickness of tuning slug 26, I is the depth tuning slug 26 penetrates into tuning cavity 50 (the "tuned" portion of tuning cavity 50), U is the distance between the bottom of tuning slug 26 and the bottom of tuning cavity 50 (the "untuned" portion of tuning cavity 50), and B is the length of the tuning cavity 50.

Discone antenna 18 is tuned by adjusting the depth tuning slug 26 penetrates into tuning cavity 50, i.e., adjusting dimension I, to optimize (minimize) VSWR. Adjusting dimension I in turn adjusts $s_{eff}$ and U. Adjusting the depth that tuning slug 26 penetrates tuning cavity 50 alters the input impedance of discone antenna 18 by a three section tapered transmission line as explained in more detail below.

Where $\mu$ is permeability, $\mu_o$ is the permeability of free space, $\epsilon$ is permittivity, $\epsilon_o$ is the permittivity of free space, and $\epsilon_r$ is relative permittivity or the dielectric constant, the characteristic impedance of a dielectric cable is given by:

$$(1/2\pi)(\sqrt{\mu/\epsilon})\ (\log_e(b/a)) \qquad (1)$$

where $\mu=\mu_o$ ($\mu_o=4\pi\times10^{-7}$ henrys/meter), $\epsilon=\epsilon_r\cdot\epsilon_o$; $\epsilon_o=(1/36\pi)\times10^{-9}$ farads/meter, and a/b is the ratio of the diameter of the inner conductor to the inside diameter of the outer conductor. The dielectric coefficient or permittivity, $\epsilon_r$ is equal to one for air. For other materials, $\epsilon_r$ may be different than one.

In discone antenna 18, tuning occurs in the tuning cavity 50, i.e., in the connector throat 46 of coaxial connector 24, and at the interface between conducting disc 28 and the top of tuning slug 26. In the connector head 48 of coaxial connector 24, the geometric relationships between the center pin 32 and the dimension M are selected in known fashion to provide a suitable impedance match.

The impedance seen due to tuning cavity 50 and the disc 28/cone 20 interface can be modeled as a tapered three section tunable transmission line. FIG. 6*a* is a schematic of such a tapered three section tunable transmission line and FIG. 6*b* is schematic of discone antenna 18. FIGS. 6*a* and 6*b* are drawn side-by-side to show the correspondence between the elements of the impedance model of FIG. 6*a* and the physical elements of discone antenna 18 shown schematically in FIG. 6*b*. Referring to FIGS. 5 and 6, the disc 28/cone 20 interface offers a complex impedance $Z_{DCI}$. The tuning slug 26 forms a short transmission line segment having a characteristic impedance $Z_{sL}$ given by equation 1 above where a is the diameter of disc feed conductor 30, (w), and b is the inside diameter of tuning slug 26, (m−2T). The untuned portion of the tuning cavity (dimension U) has a characteristic impedance $Z_U$, also given by Equation 1 where a is again the diameter of disc feed conductor 30, (w), but b is the diameter of tuning cavity 50, (m).

It is well known that altering the length of a transmission line terminated with a complex load affects the input impedance to that transmission line. FIG. 7 is a schematic of a transmission line terminated with a complex load. Referring to FIG. 7, the input impedance of a transmission line terminated with a complex load is given by:

$$Z_{in} = Z_o\left[\frac{Z_L + jZ_o[\tan(2\pi/\lambda)]L}{Z_o + jZ_L[\tan(2\pi/\lambda)]L}\right] \quad (2)$$

where $Z_{in}$ is the input impedance, $Z_o$ is the characteristic impedance of the transmission line, L is the length of the transmission line, and $Z_L$ is the complex load impedance. Therefore, by physically adjusting the depth tuning slug 26 penetrates into tuning cavity 50 of discone antenna 18 (adjusting dimension I), the physical and electrical lengths of the tunable transmission lines, i.e., $Z_U$ and $Z_{DCI}$ are altered. $Z_{DCI}$ changes due to the change in the dimension $S_{eff}$ and $Z_U$ changes due to the change in the dimension U. $Z_{sL}$ remains the same because the length of the tuning slug does not change.

The above discussion applies when changing I does not change in any way the impedance of the transmission line formed by turning slug 26, i.e., the characteristic impedance of the tuning slug transmission line remains the same over the length of the tuning slug such as is the case when there is air between the tuning slug 26 and disc feed conductor 30. However, if the characteristic impedance of the tuning slug transmission line changes at any point along its length due to changes in I, the above model will change. For example, in an embodiment of the invention, tuning cavity 50 could have a core of dielectric material concentrically extending along its length such that at least a portion of this core is disposed between tuning slug 26 and disc feed conductor 30. The impedance model would then change to a tapered four section tunable transmission line. One section would be the untuned portion of tuning cavity 50 (dimension U); a second section would be the tuned portion of tuning cavity 50 (dimension I); the third section would be the distance between the top of tuning cavity 50 (apex 22 of cone 20) where the core of dielectric material would end and the top of tuning slug 26 (sL−I); and the fourth section would be $Z_{DCI}$.

This discussion demonstrates that there are several important geometrical relationships in discone antenna 18 which must be taken into account to optimize the performance of discone antenna 18, i.e., minimizing VSWR. Applicant has found that these relationships, discussed below, are important for frequency bands where the dimension m is greater than one-twentieth of the wavelength of the lowest operating frequency (high-pass cut-off frequency) for which the discone antenna 18 is to be used.

Applicant has found that for a discone antenna (using the nomenclature set forth above) having a tuning cavity of diameter m (which, illustratively, is also the minimum cone diameter), a tuning cavity depth B, an antenna flare angle of $\theta$, a desired input impedance of $Z_{in}$, a tuning slug thickness T, and a high-pass cut-off frequency $f_c$ having a wavelength $\mu_c$, an optimum impedance match, i.e., best or lowest VSWR, is obtained when:

$$45° \leqq \theta \leqq 75° \quad (3)$$

$$sL \leqq 0.75B;\ sL \geqq T \quad (4)$$

$$T \leqq m/2 \quad (5)$$

$$m > \lambda_c/20 \quad (6)$$

$$s = 0.5\ m \quad (7)$$

$$L = 1.15\ \lambda_c/4 \quad (8)$$

$$M = 2L(\tan(\theta/2)) + m \quad (9)$$

$$D = 0.80\ M\ \{1 - [(\theta - 60°)/60°](4T/m)\} \quad (10)$$

$$I = sL - T \quad (11)$$

$$w = 0.77\ m(e^{-[Zin\times 2\pi\sqrt{\epsilon/\mu}]}) \times \{1 - (sL/B)[I/(B - I)]\ln[m/(m - 2T)]\} \quad (12)$$

$$s_{eff} = T \quad (13)$$

In designing a discone antenna, the designer would illustratively choose $Z_{in}$, $f_c$, m, B, $\theta$, T, sL and then design the discone antenna to satisfy the above relationships. Further, by setting sL and T equal to zero, the above equations will define the optimum design for a discone antenna without a tuning slug.

The above equations were derived empirically from tests conducted in the 1 to 2 GHz range. They define the optimum design for a discone antenna for use with frequencies in the UHF and microwave range. At lower frequencies, i.e., HF or VHF, large coaxial connectors would be required.

Although the invention has been described in detail with reference to certain preferred embodiments and specific examples, variations and modifications exist within the scope and spirit of the invention as described and as defined in the following claims.

What is claimed is:

1. A discone antenna for use at UHF and microwave frequencies, comprising:

(a) a conducting cone having an apex;

(b) a conducting disc having a disc feed conductor extending from its center;

(c) means for mounting the conducting disc in spaced relation to the apex of the cone such that the conducting disc's disc feed conductor extends down into the cone through the cone's apex;

(d) a tuning cavity defining member coupled to the cone and defining a tuning cavity about the conducting disc's disc feed conductor at the apex of the cone; and (e) a tuning slug having a lower portion received in the tuning cavity and an upper portion extending upwardly from the apex of the cone toward the conducting disc, the tuning cavity and the tuning slug and the conducting disc forming a tapered transmission line having a plurality of segments, each segment having an impedance, the tuning slug adjustably received in the tuning cavity to permit the depth the tuning slug penetrates into the tuning cavity to be adjusted to vary the impedance of at least two of the transmission line segments to tune the antenna where tuning of the antenna is accomplished principally by the adjustment of the tuning slug.

2. The discone antenna of claim 1 wherein the tuning cavity defining member comprises a coaxial connector to which a feed line is coupled, the coaxial connector having an upper end mounted to the cone at the apex of the cone, the coaxial connector defining the tuning cavity therein, and means for coupling the conducting disc's disc feed conductor to the coaxial connector.

3. The discone antenna of claim 2 wherein the coaxial connector has an upper throat portion which defines the tuning cavity and a lower connector head portion to which the feed line is coupled, the upper throat portion having a threaded inner surface, the tuning slug comprising a cylindrical tuning slug having a threaded outer surface, the tuning slug threadably received in the tuning cavity to permit the depth the tuning slug penetrates into the tuning cavity to be adjusted by screwing the tuning slug into and out of the tuning cavity.

4. The discone antenna of claim 3 wherein the means for coupling the conducting disc's disc feed conductor to the coaxial connector comprises the disc feed conductor having a connector pin extending from a distal end which extends into the connector head portion to be a center pin of the coaxial connector.

5. A discone antenna for use at UHF and microwave frequencies, comprising:

(a) a conducting cone having an apex;

(b) a conducting disc having a disc feed conductor extending from its center;

(c) means for mounting the conducting disc in spaced relation to the apex of the cone such that the conducting disc's disc feed conductor extends down into the cone through the cone's apex;

(d) a tuning cavity defining member coupled to the cone and defining a tuning cavity about the conducting disc's disc feed conductor at the apex of the cone; and (e) a tuning slug having a lower portion received in the tuning cavity and an upper portion extending upwardly from the apex of the cone toward the conducting disc, the tuning slug adjustably received in the tuning cavity to permit the depth the tuning slug penetrates into the tuning cavity to be adjusted to vary the impedance of the tuning cavity and the effective distance between the apex of the cone and the conducting disc to tune the antenna where tuning of the antenna is accomplished principally by adjustment of the tuning slug, the effective distance between the apex of the cone and the conducting disc comprising the distance between a top of the tuning slug and the conducting disc.

6. The discone antenna of claim 5 wherein the tuning slug is threadably and adjustably received in the cone at the apex of the cone.

7. The discone antenna of claim 5 and further including a coaxial connector for coupling the antenna to a feed line, the coaxial connector having an upper end mounted within the cone to the cone at the apex of the cone, the coaxial connector defining the tuning cavity and having a threaded inner surface for threadable receiving the tuning slug, the tuning slug being screwed into and out of the tuning cavity to vary the impedance of the tuning cavity and the effective distance between the apex of the cone and the conducting disc.

8. A discone antenna for use at UHF and microwave frequencies, comprising:

(a) a conducting cone having an apex;

(b) a conducting disc having a disc feed conductor extending from its center;

(c) means for mounting the conducting disc in spaced relation to the apex of the cone such that the conducting disc's disc feed conductor extends down into the cone through the cone's apex;

(d) a feed connector having an upper end mounted to an inner surface of the cone at the apex of the cone, the feed connector extending concentrically axially downward from the apex of the cone, the feed connector defining a tuning cavity therein about the conducting disc's disc feed conductor; and (e) a tuning slug adjustably received in the tuning cavity for vertical adjustment therein having a lower portion received in the feed connector and an upper portion extending upwardly from the apex of the cone toward the conducting disc, the distance between a top of the tuning slug and the conducting disc comprising an effective distance between the apex of the cone and the conducting disc, the tuning cavity and tuning slug and conducting disc comprising a tapered transmission line having a plurality of segments, each segment having an impedance, one segment comprising the effective distance between the apex of the cone and the conducting disc, the tuning slug adjustably received in the feed connector to permit the depth the tuning slug penetrates into the tuning cavity defined by the feed connector to be adjusted to vary the impedance of the transmission line segement which is the effective distance between the apex of the cone and the conducting disc and to vary the impedance of at least one other transmission line segment within the tuning cavity to vary the impedance of the tuning cavity to tune the antenna where tuning of the antenna is accomplished principally by adjusting the tuning slug.

9. The discone antenna of claim 8 wherein the feed connector has a threaded inner surface and the tuning slug has a threaded outer surface, the tuning slug threadably received in the feed connector for vertical adjustment therein by screwing the tuning slug into and out of the feed connector.

10. The discone antenna of claim 9 wherein the feed connector comprises a coaxial connector having an upper throat portion and a lower connector head portion, the upper throat portion defining the tuning cavity and having the threaded inner surface for threadably receiving the threaded tuning slug, the conducting disc's disc feed conductor having a connector pin at a distal end which extends into the connector head portion of the coaxial connector to act as a center pin of the coaxial connector.

11. A discone antenna for use at UHF and microwave frequencies, comprising:

(a) a conducting cone having an apex;

(b) a conducting disc having a disc feed conductor extending from its center;

(c) means for mounting the conducting disc in spaced relation to the apex of the cone such that the conducting disc's disc feed conductor extends down into the cone through the cone's apex;

(d) a tuning cavity defining member coupled to the cone and defining a tuning cavity about the conducting disc's disc feed conductor at the apex of the cone;

(e) a tuning slug having a cylindrical passage extending longitudinally therethrough, the tuning slug received in the tuning cavity so that the disc feed conductor passes through the tuning slug's passageway; and (f) the discone antenna further defined by the following relationships:

$$45° \leqq \theta \leqq 75°;$$

$$sL \leqq 0.75B;\ sL \geqq T;$$

$$T \leqq m/2;$$

$$m > \lambda_c/20;$$

$$s = 0.5\ m;$$

$$L = 1.15\ \lambda_c/4;$$

$$M = 2L(\tan(\theta/2)) + m;$$

$$D = 0.80\ M\{1 - [(\theta - 60°)/60°](4T/m)\};$$

$$I = sL - T;$$

$$w = 0.77\ m(e^{-[Z_{in} \times 2\pi\sqrt{\epsilon/\mu}]}) \times \{1 - (sL/B)[I/(B - I)]\ln[m/(m - 2T)]\};$$

$$s_{eff} = T$$

where $\theta$ is the cone flare angle, $Z_{in}$ is the desired input impedance, m is the diameter of the tuning cavity, B is the depth of the tuning cavity, sL is the length of the tuning slug, T is the wall thickness of the tuning slug, $\lambda_c$ is the high-pass cut-off wavelength, s is the distance from the apex of the cone to the conducting disc, L is the slant height of the cone, M is the maximum diameter of the cone, D is the diameter of the conducting disc, I is the depth the tuning slug penetrates into the tuning cavity, w is the diameter of the conducting disc's disc feed conductor, $\epsilon$ is the permittivity and $\mu$ is the permeability of the portion of the tuning cavity which the tuning slug penetrates, and $s_{eff}$ is the distance between the top of the tuning slug and the conducting disc.

12. The discone antenna of claim 11 wherein the tuning cavity defining member comprises a coaxial connector having an upper end mounted to the cone at the apex of the cone, the coaxial connector having an upper throat portion defining the tuning cavity therein and a lower connector heat portion, the tuning slug being threaded and the upper throat portion being threaded to threadably receive the threaded tuning slug to permit the depth the tuning slug penetrates into the tuning cavity to be adjusted by screwing the tuning slug into and out of the tuning cavity to tune the antenna.

13. A discone antenna for use at UHF and microwave frequencies, comprising:

(a) a conducting cone having an apex;

(b) a conducting disc having a disc feed conductor extending from its center;

(c) means for mounting the conducting disc in spaced relation to the apex of the cone such that the conducting disc's disc feed conductor extends down into the cone through the cone's apex;

(d) a feed connector coupled to the cone and defining a cavity about the conducting disc's disc feed conductor at the apex of the cone; and (e) the discone antenna further defined by the following relationships:

$45° \leqq \theta \leqq 75°$;

$m > \lambda_c/20$;

$s = 0.5$ m;

$L = 1.15\ \lambda_c/4$;

$M = 2L[\tan(\theta/2)] + m$;

$D = 0.80M$;

$w = 0.77\ m(e^{-[Z_{in} \times 2\pi\sqrt{\epsilon/\mu}]})$ where $\theta$ is the cone flare angle, $Z_{in}$ is the desired input impedance, m is the minimum diameter of the cone, $\lambda_c$ is the high-pass cut-off wavelength, s is the distance from the apex of the cone to the conducting disc, L is the slant height of the cone, M is the maximum diameter of the cone, D is the diameter of the conducting disc, w is the diameter of the conducting disc's disc feed conductor, $\epsilon$ is the permittivity and $\mu$ is the permeability of the cavity.

14. The discone antenna of claim 13 wherein the feed connector comprises a coaxial connector having an upper end mounted to the cone at the apex of the cone.

* * * * *